US007434290B2

(12) United States Patent
Bouland et al.

(10) Patent No.: US 7,434,290 B2
(45) Date of Patent: Oct. 14, 2008

(54) EXTENSION PART AND SWEEPER BODY FOR WEED MOWERS

(76) Inventors: Meint Johannes Bouland, Symfonie 35, NL-3335 BH Zwijndreem NL, Zwijndrecht (NL); Peter Frank Van Leeuwen, Gouwzeetraat 1, NL 1382 KD Weesp, Weesp (NL)

( * ) Notice: Subject to any disclaimer, the term of this patent is extended or adjusted under 35 U.S.C. 154(b) by 0 days.

(21) Appl. No.: 10/565,711

(22) PCT Filed: Jul. 8, 2004

(86) PCT No.: PCT/EP2004/007629

§ 371 (c)(1),
(2), (4) Date: Dec. 8, 2006

(87) PCT Pub. No.: WO2005/013765

PCT Pub. Date: Feb. 17, 2005

(65) Prior Publication Data

US 2007/0094825 A1 May 3, 2007

(30) Foreign Application Priority Data

Jul. 25, 2003 (EP) ..... 03077349

(51) Int. Cl.
*A46B 7/08* (2006.01)
*A46B 13/00* (2006.01)

(52) U.S. Cl. ..... 15/180; 15/183

(58) Field of Classification Search ..... 15/179, 15/180, 183

See application file for complete search history.

(56) References Cited

FOREIGN PATENT DOCUMENTS

DE 40 13 530 * 10/1991
FR 2 614 188 * 10/1988

* cited by examiner

*Primary Examiner*—Randall Chin
(74) *Attorney, Agent, or Firm*—McDermott Will & Emery LLP

(57) ABSTRACT

The present invention relates to a modified extension part (1) and sweeper body (6) for weed mowers, in which the mentioned extension part (1) is constructed as a cylindrical disc provided with through and through recesses (7) and at least two opposite to each other not through and through milled-out recesses (5, 51) to receive in a very inventive way the triangular or polygonal bushes (15) with sweeper body (6) constructed as steel cable (14), and pressed on the end a preferably triangular bush or cover (15), in which locking is done by means of a spring loaded blocking pin (10) and can be pushed in with the thumb and finger to replace the sweeper body for which a recess (16) comes free and the sweeper body can be replaced, through which in a surprising easy way and without the requirements of tools the sweeper body (6) of the extension part (1) can be replaced.

8 Claims, 3 Drawing Sheets

EXTENSION PART AND SWEEPER BODY FOR WEED MOWERS

The present invention relates to a device constructed as a brush assembly consisting of a rotating extension part with applied therein sweeper bodies to mount on or underneath a so called weed mower and similar devices for mainly cleaning and/or removing weed between hard surface elements, in which the mentioned extension part has the form of a cylindrical-shaped disc, has a central mounting drill and weight saving recesses, in which in the mentioned pick-up recesses a sweeper body is mounted with a bush, which is clamped on or pressed on, which bush is provided with wire bundles or twisted steel wires, for example, a piece of steel cable.

A somewhat similar device or extension part for weed mowers is known from the European Patent "Improved Extension Part for Weed Mowers" nr. 02078082, submitted 25 of Jul. 2002, also of BOULAND, Meint, Johannes.

In mentioned patent document it concerns an extension part for so called weed mowers, in order to remove plant remains, weeds, dirt and such from paved surfaces and is built as a rotating device with sweeper bodies. Here, the extension part also consists of a small brush disc with six pick-up recesses for sweeper bodies in which a wire bundle or steel cable is pressed in a quadrangular cover. In the mentioned quadrangular cover a bore is applied, from which a spring loaded pin protrudes from the disc, which is provided with a bolt head and can be pulled out with a special spanner to replace the sweeper body. Replacing the sweeper bodies, which are subject to heavy wear, consisting of a quadrangular cover pressed on the end of a piece of steel cable is very frequently necessary. Working with pieces of steel cable provided with a cover as sweeper body has proven to be very favourable in practice. These pieces of steel cable are placed in a rotating sweeper device and is accordingly frequently used in a large number of municipals on a national and international scale.

In practice, the aforementioned shortly described extension part with sweeper bodies has a number of disadvantages, being that for the small diameter of the brush disc of the weed mower not so many pick-up recesses are needed, a much easier replacement of the worn sweeper bodies is desirable, the brush disc itself should be lighter, the brushes of the sweeper body should be easier to attach and should be done in one movement without requiring any tools, while still an optimal safety of the strong and solid attachment of the sweeper body to the brush disc is guaranteed. It is important to place the bush or cover of the sweeper body in one manner in the pick-up recess of the brush disc in order to put the mentioned pin in the bore of the mentioned cover, otherwise too much time is needed to replace the sweeper body, which causes annoyance and loss of time for the user.

It is the aim of the present invention to provide such a modified or improved extension part for weed mowers and such, in which the aforementioned disadvantages are solved and in which extension and sweeper parts can be put onto the market in an economical way.

For this the extension part with sweeper body according to the invention is further developed and/or modified in a very inventive way, characterized in that the mentioned extension part is constructed as a cylindrical disc with thickness H, diameter D, central mounting drill and at least two spoke-shaped solid wide strips, in which the intermediate segments have at least a through and through recess, in which mentioned spoke-shaped solid wide strips positioned opposite from each other with equal angles at the centre axis near the circumference of the mentioned extension part, triangular or polygonal at the corners rounded milled-out not through and through recesses are introduced to receive the corresponding also triangular or polygonal shaped bushes or covers with sweeper body, in which locking of the mentioned bush or cover is done by means of a partly cylindrical or segmental shaped recess in an angle of the mentioned bush or cover and attached in a radial bore in the mentioned spoke-shaped solid wide strip provided with a spring-loaded blocking pin, in which the mentioned extension part is made of a material with sufficient tensile strength and elastic modulus and the material is further well mechanically processable.

The advantage is a very handy and easy to replace sweeper body, through which working with a weed mower or similar device becomes much less strenuous, in which the bush or cover with the sweeper body can be mounted in only one way, without the requirement of tools. Further, the bush or cover of the sweeper body can also have other cross-sections, which can always only be mounted in one way and which can be secured in the same way.

Further, the device according to the invention is further developed in such a way, that the mentioned spring-loaded blocking pin is constructed of an axle or shaft with a part with a larger diameter D1 and a part with a smaller diameter D2, in which the transition between them shows a conical peg shoulder, which in mounted locked position stops against a clamping pin or locking pin and in which the axle part with diameter D1 has a central bore for receiving a pressure spring, in which the radial bore of the whole is applied from the outside, this and that in such a way that in use, due to the centrifugal force, mentioned spring-loaded blocking pin with the mentioned peg-shoulder is thoroughly pressed against the mentioned clamping pin or locking pin, so locking is optimally secured.

The advantage is a fast and without the requirement of tools manual replacement of the sweeper body.

Furthermore the device according to the invention is further developed in such a way, that the embodiment constructed as triangular shaped bushes or covers, being one of the preferred embodiments of the sweeper device, form an equilateral triangle, in which two angles have an equal radius of curvature R1 and the third angle has a deviant radius of curvature R2, provided with the mentioned recess with radius of curvature of approximately 6.5 mm matching with diameter D1 of 13 mm, and that mentioned radius of curvature R1 is approximately 8.65 mm and R2 approximately 10.15 mm.

The advantages are a direct in one way manual, in which no tools are required, mountable sweeper body, that in operation, due to the springy axle lock, stays operationally safe in the extension part.

The preferred construction of the invention will be described by way of example, and with reference to the accompanying drawing.

In which.

Figure 1:
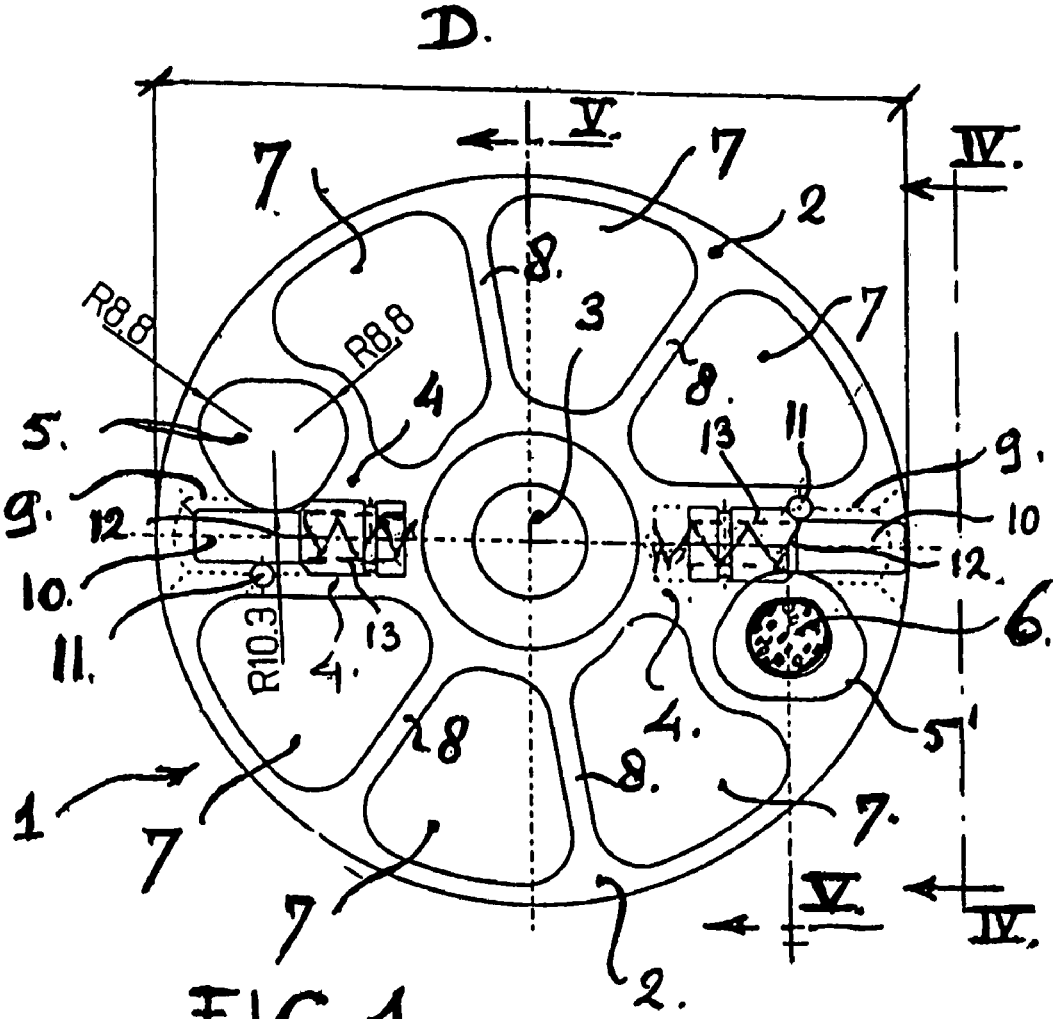
FIG. 1 shows a front view of the extension part according to a preferred embodiment of the invention.

FIG. 1 shows a front view or bottom view of the extension part 1 according to a preferred embodiment of the invention. The mentioned extension part 1 consists of a disc 2 with diameter D, a central mounting bore 3, a radial or spoke-shaped solid wide strip or spoke 4, milled-out triangular not through and through recesses 5, $5^1$, in which $5^1$ is supplied with a sweeper body 6, remaining openings 7, which, by removing the partition walls 8 on both sides, can be made into one large segment-shaped opening. The mentioned sweeper body 6 is also shown in FIGS. 2 and 3.

Figure 7:
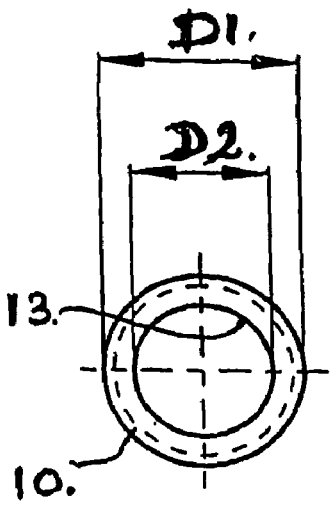
FIG. 7 shows a front view over the line VII of FIG. 6.
Figure 6:
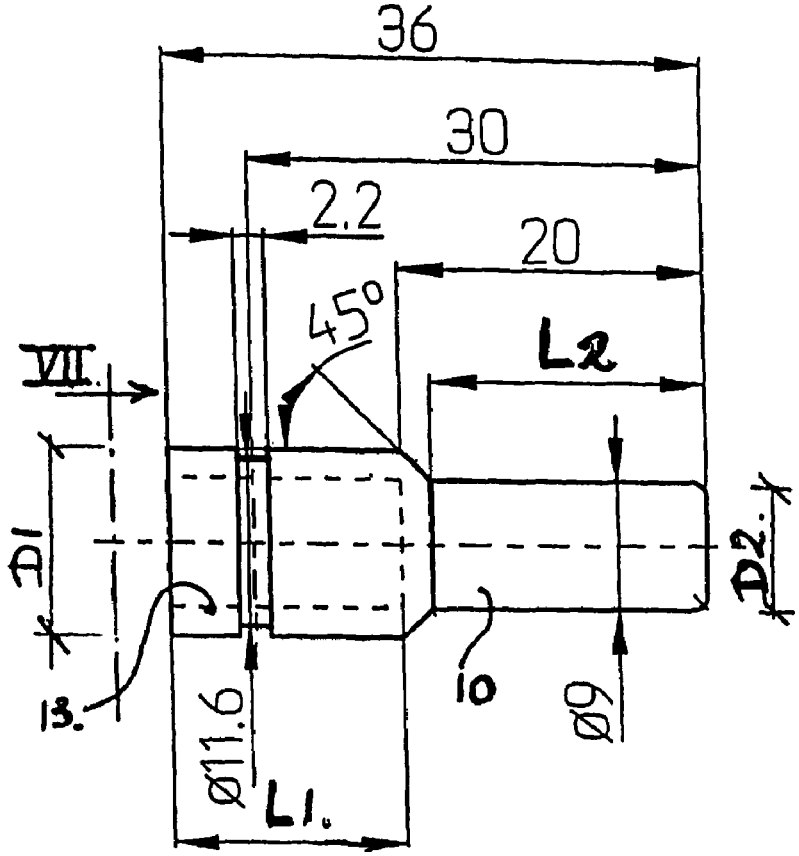
FIG. 6 shows a side view of the spring-loaded pin for locking the sweeper body.

Further the extension part 1 of FIG. 1 in the radial or spoke-shaped solid wide strip 4 is supplied with radial bores 9, in which the spring-loaded blocking pins 10 are mounted, of which shooting out is avoided by the clamping pin or locking pin 11. A spring 12 is situated in bore 13, as shown in FIGS. 6, 7. The blocking pin 10 can be pushed in with one finger, so that when replacing the sweeper body 6 tools are no longer necessary. The sweeper body 6 (FIG. 2, 3) preferably consists of a steel cable 14 on which, in this case at the end, a triangular aluminium bush or cover 15 with rounded corners is pressed. Here, the corners are rounded with radiuses R1 and R2, in which in the corner with radius of curvature R2 a recess is stamped or pressed to receive the moved back blocking pin 10.

Figure 4:
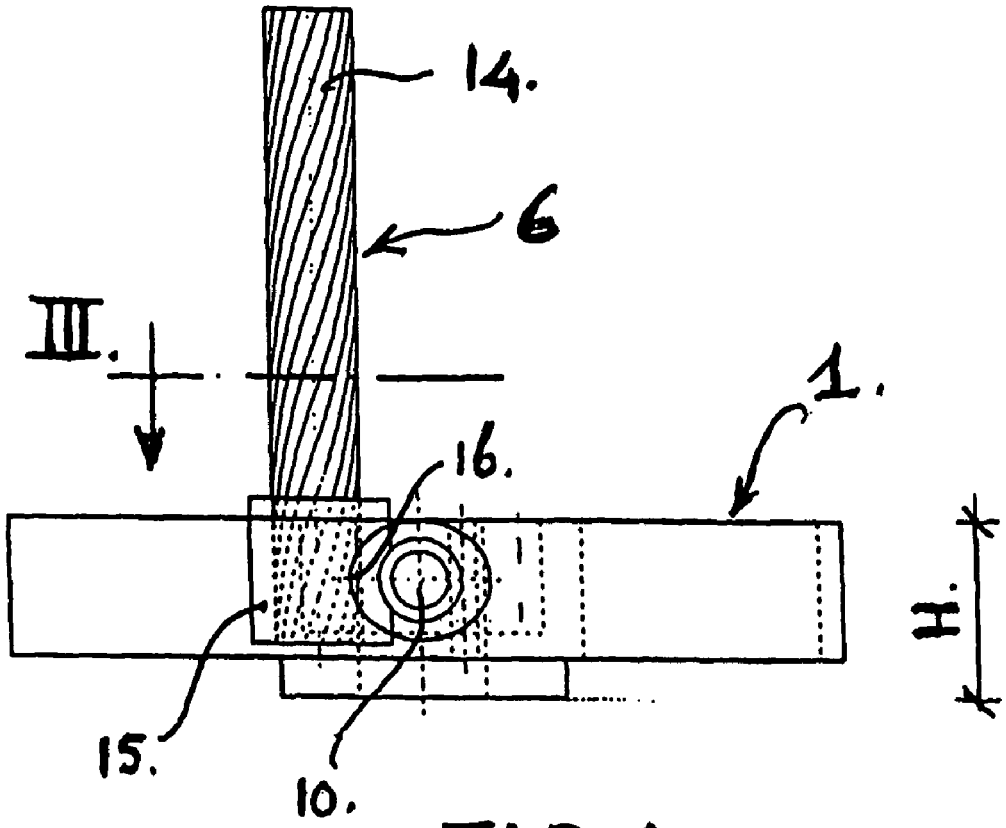
FIG. 4 shows a side view over the line IV-IV of the extension part of FIG. 1.
Figure 5:
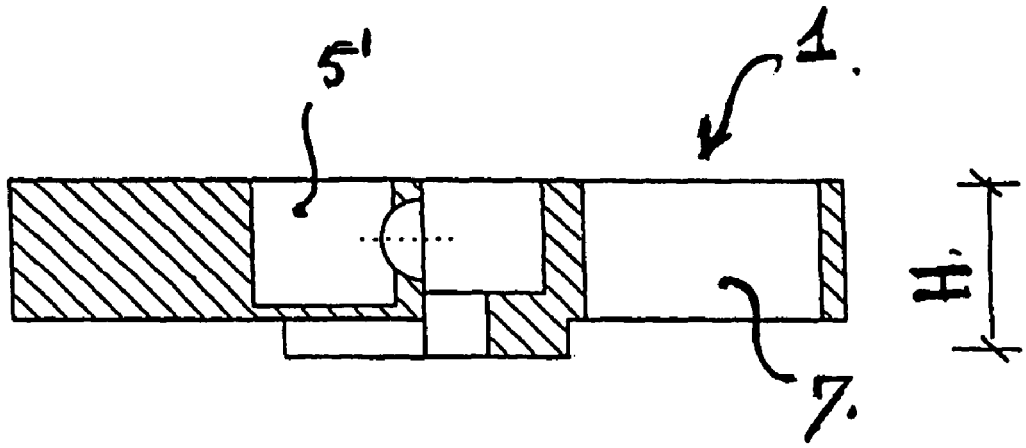
FIG. 5 shows a cross section over the line V-V of the extension part of FIG. 1.

FIGS. 4 and 5 show a side view, respectively cross-section over the line IV-IV and V-V of FIG. 1.

Figure 2:
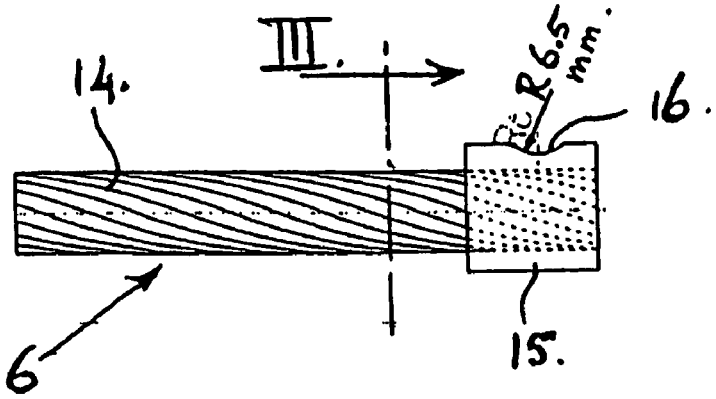
FIG. 2 shows a side view of the sweeper body according to a preferred embodiment of the invention.
Figure 3:
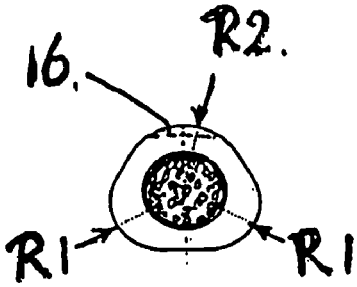
FIG. 3 shows a cross-section over the line III of FIG. 2.

Blocking or locking of the bush 15 of the sweeper body 10 with recess 16 is clearly shown in FIGS. 2 and 4.

FIG. 5 shows a triangular recess $5^1$ for the sweeper body 10.

FIGS. 6 and 7 show in detail a side and front view the blocking pin 10 of FIG. 1. The bore 13 for the compression spring (not indicated) also has a diameter D2 of approximately 9 mm. The lengths and diameters are chosen in such a way that the bigger diameter of the axle bumps in a suitable way against the locking pin 11 (see FIG. 1).

Finally it has to be emphasized, that the above description constitutes a preferred embodiment of the present invention and that further variations and modifications are still possible without departing the scope of this patent description.

The invention claimed is:

1. A rotating brush assembly for a weed mower that accepts removable and replaceable brushes comprising:

a cylindrical disc including a central mounting bores, at least two spokes, and partition walls, said disc further including at least one through bore between each adjacent partition wall, wherein at least two opposing spokes include polygonal shaped recesses having rounded corners for receiving the removable and replaceable brushes, wherein each of the brushes are locked into place within said polygonal shaped recesses by a spring-loaded blocking pin which mates with a recess in the brush, said spring-loaded blocking pin being located within a radial bore in each spoke, further wherein said disc is made of a material with sufficient tensile strength and elastic modulus, and said material being mechanically processable.

2. The brush assembly of claim 1 wherein said disc is approximately 22-28 mm thick and approximately 129 mm in diameter.

3. The brush assembly of claim 1 wherein said spring-loaded blocking pin includes a shaft including a first portion having a first diameter and a second portion having a second diameter, wherein said second diameter is smaller than said first diameter, said shaft further including a conical shoulder transition portion between said first portion and said second portion, further wherein said second diameter includes a central bore for receiving a spring, wherein said spring biases said conical shoulder against a locking pin located in said spoke to lock said blocking pin in place.

4. The brush assembly of claim 3 wherein said first diameter is approximately 13 mm and the first portion is approximately 16 mm in length, and said second diameter is approximately 9 mm and the second portion is approximately 18 mm in length.

5. The brush assembly of claim 4, wherein said polygonal shaped recesses having rounded corners are triangular, with two angles having an equal radius of curvature and the third angle having a different radius of curvature and said recess in said brush is a radius of approximately 6.5 mm to mate with the first diameter of approximately 13 mm.

6. The brush assembly of claim 5 wherein the two angles of equal radius of curvature have a radius of curvature of approximately 8.65 mm and the third angle has a radius of curvature that is approximately 10.15 mm.

7. The brush assembly of claim 1 wherein said disc is made of aluminum.

8. The brush assembly of claim 1 wherein said disc is made of polypropylene.

* * * * *